US009310748B2

(12) United States Patent
Kato

(10) Patent No.: US 9,310,748 B2
(45) Date of Patent: Apr. 12, 2016

(54) CLEANING BLADE AND IMAGE FORMING APPARATUS

(71) Applicant: Oki Data Corporation, Tokyo (JP)

(72) Inventor: Ken Kato, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/712,086

(22) Filed: May 14, 2015

(65) Prior Publication Data

US 2015/0331384 A1 Nov. 19, 2015

(30) Foreign Application Priority Data

May 16, 2014 (JP) ..... 2014-102678

(51) Int. Cl.
*G03G 21/00* (2006.01)

(52) U.S. Cl.
CPC ..... *G03G 21/00* (2013.01); *G03G 21/0017* (2013.01); *G03G 2215/0141* (2013.01)

(58) Field of Classification Search
CPC ..... G03G 21/0017; G03G 21/0011; G03G 21/1814; G03G 2221/001; G03G 2221/183; G03G 21/00
See application file for complete search history.

(56) References Cited

U.S. PATENT DOCUMENTS

2004/0170455 A1* 9/2004 Shintani ..... G03G 21/0011 399/350
2005/0031978 A1* 2/2005 Lee ..... G03G 9/08704 430/108.11
2006/0066996 A1* 3/2006 Ishiguro ..... G11B 5/41 360/128
2008/0085459 A1* 4/2008 Kami ..... G03G 5/0542 430/66

FOREIGN PATENT DOCUMENTS

JP 55164637 * 6/1982 ..... G03G 5/02
JP 2010-217403 A 9/2010

* cited by examiner

*Primary Examiner* — Roy Y Yi
(74) *Attorney, Agent, or Firm* — Muncy, Geissler, Olds & Lowe, P.C.

(57) ABSTRACT

A cleaning blade is arranged to contact a surface of an image carrier to remove a developer on the surface of the image carrier. The cleaning blade is made of an elastic body in which a loss elastic modulus at a temperature of 100° C. and a frequency of 10 Hz is set within a range of $3.0\times10^4$ Pa to $2.61\times10^5$ Pa (inclusive).

20 Claims, 8 Drawing Sheets

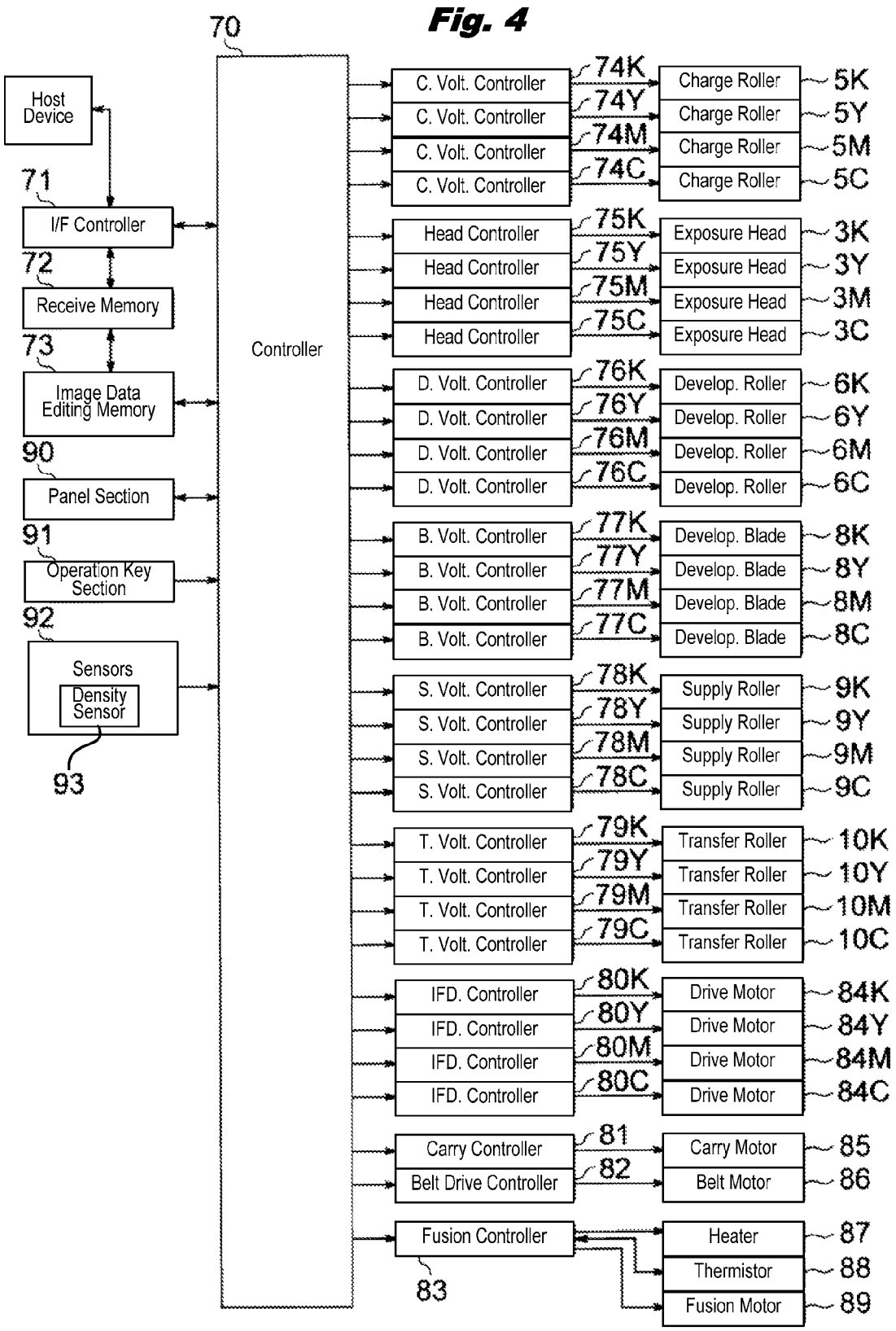
Fig. 4
70
Host Device
71
I/F Controller
72
Receive Memory
73
Image Data Editing Memory
90
Panel Section
91
Operation Key Section
92
Sensors
Density Sensor
93
Controller
C. Volt. Controller
74K
74Y
74M
74C
Charge Roller
5K
5Y
5M
5C
Head Controller
75K
75Y
75M
75C
Exposure Head
3K
3Y
3M
3C
D. Volt. Controller
76K
76Y
76M
76C
Develop. Roller
6K
6Y
6M
6C
B. Volt. Controller
77K
77Y
77M
77C
Develop. Blade
8K
8Y
8M
8C
S. Volt. Controller
78K
78Y
78M
78C
Supply Roller
9K
9Y
9M
9C
T. Volt. Controller
79K
79Y
79M
79C
Transfer Roller
10K
10Y
10M
10C
IFD. Controller
80K
80Y
80M
80C
Drive Motor
84K
84Y
84M
84C
Carry Controller
81
Carry Motor
85
Belt Drive Controller
82
Belt Motor
86
Fusion Controller
83
Heater
87
Thermistor
88
Fusion Motor
89

CLEANING BLADE AND IMAGE FORMING APPARATUS

CROSS REFERENCE

The present application is related to, claims priority from and incorporates by reference Japanese Patent Application No. 2014-102678, filed on May 16, 2014.

TECHNICAL FIELD

The present invention relates to an image forming apparatus using an electrophotographic system and its cleaning blade.

BACKGROUND

Conventionally, in an image forming apparatus using an electrophotographic system, a surface of a photosensitive drum as an image carrier is charged evenly with a charge roller, and then exposed by an exposure head, etc., to form an electrostatic latent image. The electrostatic latent image formed on the surface of the photosensitive drum as mentioned above is developed by adhering a toner (developer) with a development roller, and the developed toner image is transferred to a recording medium with a transfer roller. Further, the toner image transferred to the recording medium is fused with a fuser device.

Further, the toner not transferred to the recording medium and remained on the photosensitive drum is removed with a cleaning blade (see, for example, Patent Document 1).

RELATED ART

[Patent Document 1] JP 2010-217403, A

In recent years, for the purpose of attaining high-quality of an image and speeding up the image formation, decreasing of the particle diameter of the toner and/or lowing of the melting point thereof have been developed. In accordance with this development, there is a tendency that the toner contains a large amount of external additives. In the case of using a large amount of such external additives, image quality may deteriorate.

The present invention has been made to solve the aforementioned problems, and aims to provide a cleaning blade and an image forming apparatus capable of obtaining a good image quality.

SUMMARY

A cleaning blade is disclosed in the application, arranged to contact a surface of an image carrier to remove a developer on the surface of the image carrier. The cleaning blade is made of an elastic body in which a loss elastic modulus at a temperature of 100° C. and a frequency of 10 Hz is set within a range of $3.0\times10^4$ Pa to $2.61\times10^5$ Pa (inclusive).

An image forming apparatus disclosed in the application includes an image carrier; and a cleaning blade arranged to contact a surface of the image carrier to remove a developer on the surface of the image carrier. The cleaning blade is made of an elastic body in which a loss elastic modulus at a temperature of 100° C. and a frequency of 10 Hz is set within a range of 3.0×104 Pa to 2.61×105 Pa (inclusive).

In concrete embodiments shown in the present invention, the image quality can be improved.

BRIEF DESCRIPTION OF THE DRAWINGS

FIG. 4 illustrates a block diagram showing a control system of the image forming apparatus according to the first embodiment.

PREFERRED EMBODIMENTS OF THE INVENTION

First Embodiment

Structure of Image Forming Apparatus

Figure 1:
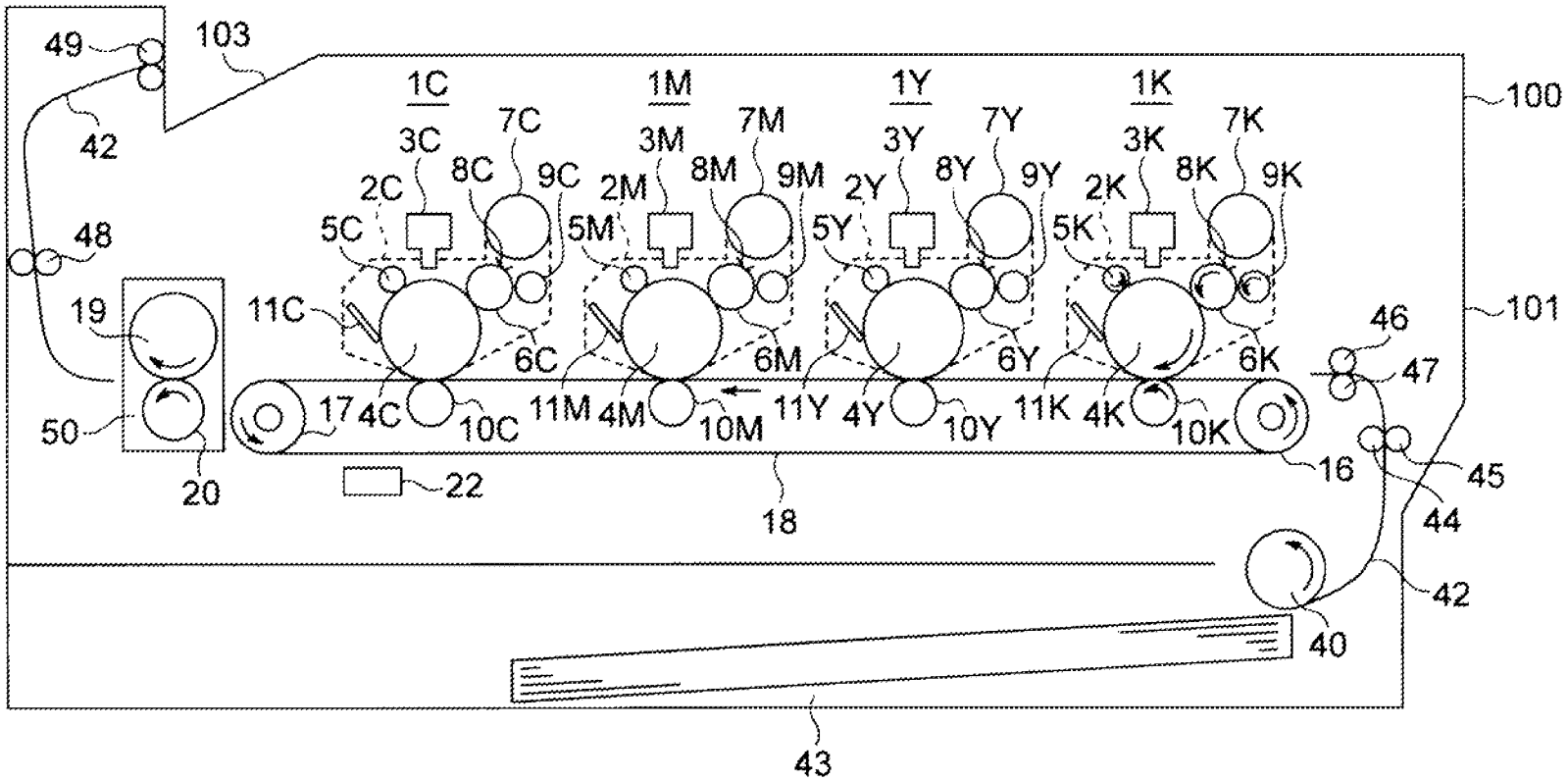
FIG. 1 illustrates a structure of an image forming apparatus according to a first embodiment of the present invention.

Initially, an image forming apparatus 100 according to a first embodiment of the present invention will be explained. FIG. 1 is a view showing a structure of the image forming apparatus 100 according to the first embodiment.

The image forming apparatus 100 shown in FIG. 1 is a printer for forming a color image using an electrophotographic method, and includes image forming units 1K, 1Y, 1M, and 1C for forming images of black, yellow, magenta and cyan, respectively. The image forming units 1K, 1Y, 1M, and 1C are arranged in sequence along a medium carrying path 42 of the recoding medium 41 from the upstream side to the downstream side (from the right to the left in FIG. 1). Further, the image forming units 1K, 1Y, 1M, and 1C are detachably mounted on an apparatus main body 101 of the image forming apparatus 100.

The image forming unit 1K, 1Y, 1M, 1C is provided with a photosensitive drum 4K, 4Y, 4M, 4C as an image carrier for carrying a toner image (developer image). The photosensitive drum 4K, 4Y, 4M, 4C is a drum-shaped member having a photoreceptive layer on a surface of a conductive support.

Around the photosensitive drum 4K, 4Y, 4M, 4C, a charge roller 5K, 5Y, 5M, 5C for evenly charging the surface of the photosensitive drum 4K, 4Y, 4M, 4C, an exposure head 3K, 3Y, 3M, 3C for forming an electrostatic latent image by irradiating a light onto the surface of the photosensitive drum 4K, 4Y, 4M, 4C, a development roller 6K, 6Y, 6M, 6C for developing an electrostatic latent image by toner (developer), and a cleaning blade 11K, 11Y, 11M, 11C for scraping the toner remained on the surface of the photosensitive drum 4K, 4Y, 4M, 4C are arranged Further, the image forming unit 1K, 1Y, 1M, 1C is provided with a supply roller 9K, 9Y, 9M, 9C for supplying toner to the development roller 6K, 6Y, 6M, 6C, and a development blade 8K, 8Y, 8M, 8C for controlling a thickness of a toner layer formed on the surface of the development roller 6K, 6Y, 6M, 6C. These development roller 6K, 6Y, 6M, 6C, the supply roller 9K, 9Y, 9M, 9C and the development blade 8K, 8Y, 8M, 8C constitute a development unit 2K, 2Y, 2M, 2C. To the development unit 2K, 2Y, 2M and 2C, a toner cartridge 7K, 7Y, 7M, 7C (developer container) for supplying a toner of each color is detachably attached.

Below the image forming apparatus 100, a sheet feeding cassette (medium accommodation portion) 43 for accommodating a recording medium 41 (print sheet) and a hopping roller (sheet feeding means) 40 for discharging the recording medium 41 in the sheet feeding cassette 43. The sheet feeding cassette 43 is configured to accommodate a plurality of recording media 41 in a stacked manner and is detachably mounted to the main body 101 of the image forming apparatus 100. The hopping roller 40 is arranged so as to come in contact with the surface of the uppermost recording medium 41 in the sheet feeding cassette 43 and rotates to feed the recording medium 41 to the medium carrying path 42.

On the downstream side of the hopping roller 40 along the medium carrying path 42, a registration roller pair 44 and 45 and a carrying roller pair 46 and 47 are arranged. The registration roller pair 44 and 45 starts rotating after a certain standby time has passed since the recording medium 41 has reached the nip pair of the registration roller pair 44 and 45, and carries the recording medium 41 toward the carrying roller pair 46 and 47 while correcting the skew of the recording medium 41. The carrying roller pair 46 and 47 carries the recording medium 41 carried from the registration roller pair 44 and 45 toward the image forming units 1K, 1Y, 1M and 1C.

On the lower side of the image forming unit 1K, 1Y, 1M, 1C, a transfer roller 10K, 10Y, 10M, 10C as a transfer member is provided so as to face the photosensitive drum 4K, 4Y, 4M, 4C. To the transfer roller 10K, 10Y, 10M, 10C, a transfer voltage for transferring the toner image formed on the photosensitive drum 4K, 4Y, 4M, 4C to the recording medium 41 by Coulomb force is applied.

On the downstream side and the upstream side of the transfer roller 10K, 10Y, 10M, 10C along the medium carrying path 42, a belt driving roller 17 and a belt driven roller 16 are arranged. A carrying belt 18, which is an endless belt, is arranged on the belt driving roller 17 and the belt driven roller 16.

The carrying belt 18 is arranged so as to pass between the photosensitive drum 4K, 4Y, 4M, 4C and the transfer roller 10K, 10Y, 10M, 10C. The carrying belt 18 is configured to absorb and hold the recording medium 41 on the surface. The belt driving roller 17 is a roller for driving the carrying belt 18, and the belt driven roller 16 is a roller for giving a certain tension to the carrying belt 18. When the belt driving roller 17 rotates, the carrying belt 18 travels and carries the recording medium 41 while holding the recording medium 41 on a surface of the carrying belt 18.

Further, below the carrying belt 18, a sensor 22 is arranged so as to face the carrying belt 18. This sensor 22 reads the density of the print pattern printed on the surface of the carrying belt 18.

On the downstream side of the image forming unit 1K, 1Y, 1M, 1C along the medium carrying path 42, a fuser device 50 is provided. The fuser device 50 is equipped with a fuser roller 19 embedding a heater (e.g., halogen lamp) for heating the recording medium 41 and a fuser backup roller (pressure application roller) 20 for pressing the recording medium 41 against the fuser roller 19. The fuser device 50 fuses a toner image on the recording medium 41 by applying heat and pressure to the recording medium 41 to which a toner image was transferred.

On the downstream side of the fuser device 50 along the medium carrying path 42, election rollers 48 and 49 for ejecting the recording medium 41 on which the toner image was fused are arranged. Further, the upper cover of the image forming apparatus 100 is provided with a stacker part 103 for stacking the recording medium 41 ejected by the ejection rollers 48 and 49.

<Image Forming Unit>

Figure 2:
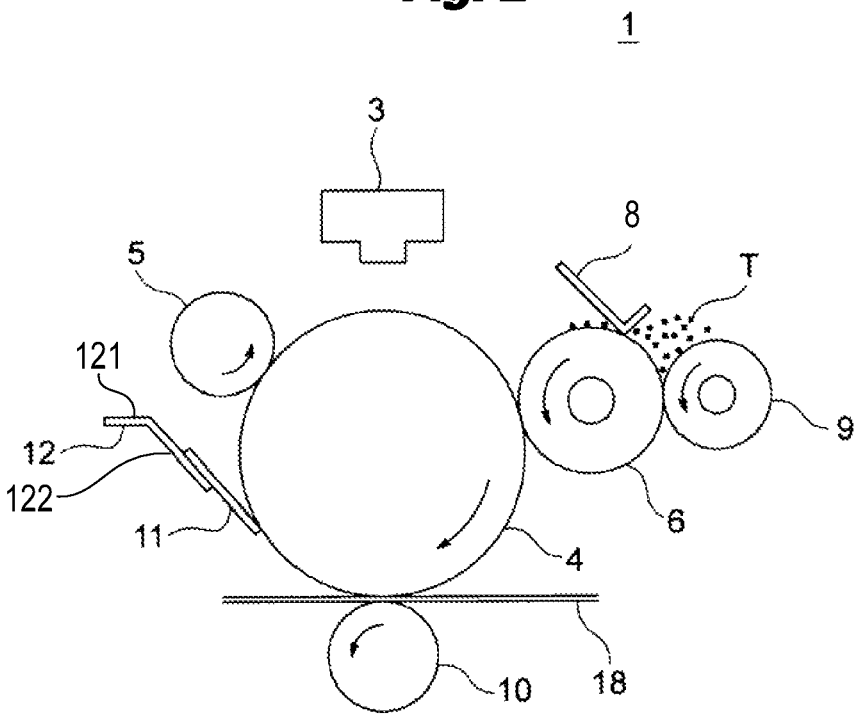
FIG. 2 illustrates a structure of the image forming unit according to the first embodiment of the present invention.

FIG. 2 illustrates a structure of the image forming unit 1. The image forming units 1K, 1Y, 1M and 1C have a common structure except for a toner used, and therefore will be collectively referred to as an "image forming unit 1. In the same manner, the photosensitive drums 4K, 4Y, 4M and 4C will be collectively referred to as a "photosensitive drum 4," and the charge rollers 5K, 5Y, 5M and 5C will be collectively referred to as a "charge roller 5." Further, the exposure heads 3K, 3Y, 3M, and 3C will be collectively referred to as an "exposure head 3," and the development rollers 6K, 6Y, 6M, and 6C will be collectively referred to as a "development roller 6." Further, the supply rollers 9K, 9Y, 9M, and 9C will be collectively referred to as a "supply roller 9," and the development blades 8K, 8Y, 8M, and 8C will be referred to as a "development blade 8." The cleaning blades 11K, 11Y, 11M, and 11C will be collectively referred to as a "cleaning blade 11."

The photosensitive drum 4 includes a conductive support of a cylindrical shape, and a photoreceptive layer formed on the surface of the conductive support. The conductive support can be constituted by, for example, a metal material such as aluminum, aluminum alloy, stainless steel, copper, nickel, etc., or a resin material containing conductive powder (metal, carbon, tin oxide). Here, the conductive support is formed by a metal material (more specifically, aluminum).

The photoreceptive layer can be constituted by a 1 photoreceptive layer (1 layer type photoreceptive layer) in which photo-conductive materials are dissolved or dispersed in a binder resin, or can be constituted by a laminated type photoreceptive layer in which a charge generation layer containing a charge generation substance and a charge transportation layer containing a charge transportation substance are laminated. The 1 photoreceptive layer is positively chargeable and the laminated type photoreceptive layer is negatively chargeable. Here, a laminated type photoreceptive layer is used.

In the case of a laminated type photoreceptive layer, an undercoat layer is further formed between the surface of the conductive support and the photoreceptive layer. The undercoat layer is formed by dispersing particles such as metallic oxides (e.g., titanium oxides) in a binder resin, and is provided to improve the adhesion property and the blocking property.

The photosensitive drum 4 is formed by forming an undercoat layer, a charge generation layer, and a charge transportation layer in turn on a surface of the conducive support by, for example, an immersion coating method, a spray coating method, or a blade coating method. Here, an immersion coating method is used.

In the immersion coating method, a conductive support is immersed (dipped) in an application liquid in which metallic oxide particles are dispersed in a solution in which a binder resin (e.g., epoxy resin, polyethylene resin, etc.) is dissolved, and then the conductive support is pulled out from the application liquid and dried to thereby form an undercoat layer on the surface of the conductive support. Thereafter, the conductive support is immersed in an application liquid in which charge generation substances are dispersed in a solution in which binder resin (e.g., polyvinyl butyral resin, polyvinyl formal resin, etc.) is dissolved, and then the conductive support is pulled out from the application liquid and dried to thereby form a charge generation layer on the surface of the undercoat layer. Further, the conductive support is immersed in the application liquid in which charge transportation substances are dispersed in a solution in which binder resin (e.g., polyvinyl butyral resin, polyvinyl formal resin, etc.) is dissolved, and then the conductive support is pulled out from the application liquid and dried to thereby form a charge transportation layer on the surface of the charge generation layer.

In this embodiment, for example, the drying condition at the time of forming the charge transportation layer which is the outermost layer of the photosensitive drum 4 is adjusted to thereby adjust the Vickers hardness (which will be described) of the surface of the photosensitive drum 4. Here, the outer diameter of the photosensitive drum 4 is set to 30 mm, and the film thickness of the photoreceptive layer (charge generation layer and the charge transportation layer) is set to be 21 μm.

The charge roller 5 (charge member) is arranged so as to come into contact with the surface of the photosensitive drum 4 and rotated in accordance with the rotation of the photosensitive drum 4. The charge roller 5 is a roller in which, for example, a semiconductive epichlorohydrin rubber is formed on the surface of a metallic shaft. Further, to the charger roller 5, a charge voltage is applied by a charge voltage controller which will be explained later to evenly charge the surface of the photosensitive drum 4.

The exposure head 3 (exposure device) is equipped with a light-emitting element array in which a plurality of LEDs (light-emitting diodes) is arranged in one direction and a lens array in which a plurality of lenses is arranged in one direction. The exposure head 3 is configured to condense a light emitted from each LED by a lens to the surface of the photosensitive drum 4.

The development roller 6 (developer carrier) is arranged so as to come in contact with the surface of the photosensitive drum 4, and rotates in a direction opposite to the rotation direction of the photosensitive drum 4 (that is, rotates such that the moving direction of the surface at the opposed portion becomes in the forward direction). The development roller 6 is a roller in which a semiconductive urethane rubber is formed on the surface of the metallic shaft. Further, to the development roller 6, a development voltage is applied by a development voltage controller which will be described later to develop an electrostatic latent image on the surface of the photosensitive drum 4.

The supply roller 9 (supply member) is arranged so as to come into contact with the surface of the development roller 6, and rotates in the same direction as the rotation direction of the development roller 6 (i.e., the moving direction of the surfaces at the opposed portion become opposite directions). The supply roller 9 is a roller in which, for example, a semiconductive urethane rubber is formed on the surface of the metallic shaft. Further, to the supply roller 9, to supply a toner to the development roller 6, a supply voltage is applied by a supply voltage controller which will be explained later.

The development blade 8 (development regulatory member) is a member formed by bending, for example, an elongated plate-like stainless member into approximately an L-shaped in cross-section perpendicular to the longitudinal direction. The development blade 8 is arranged so that the outside surface of the bent portion is in contact with the surface of the development roller 6. Further, to the development blade 8, to control the charge amount of the toner layer on the development roller 6, a blade voltage is applied by a blade voltage controller which will be explained later.

The transfer roller 10 (transfer member) is arranged so as to pinch the carrying belt 18 between the roller and the photosensitive drum 4 and rotates in accordance with the rotation of the photosensitive drum 4. The transfer roller 10 is a roller in which, for example, a foamed rubber such as, e.g., acrylonitrile-butadiene rubber (NBR) is formed on the surface of a metallic shaft. To the transfer roller 10, in order to transfer a toner image on the surface of the photosensitive drum 4 to the recording medium 41, a transfer voltage is applied by a transfer voltage controller which will be explained later.

The cleaning blade 11 is arranged between the transfer roller 10 and the charge roller 5 in the rotation direction of the photosensitive drum 4. The cleaning blade 11 is configured to scrape the transfer residual toner remained on the surface of the photosensitive drum 4 with the tip end portion of the blade pressed against the surface of the photosensitive drum 4. The cleaning blade 11 is an elongated member extending in the axial direction of the photosensitive drum 4 and formed by an elastic member such as a rubber, etc., (more specifically, urethane rubber).

The cleaning blade 11 is fixed to the main body of the image forming unit 1 by a blade holder 12. In the example shown in FIG. 2, the blade holder 12 has a horizontal section 121 extending horizontally and an inclined section 122 inclined obliquely downward (toward the outer periphery of the photosensitive drum 4). But, the blade holder is not limited to have such a shape, but can be, for example, a plate-shaped member.

Figure 3A:
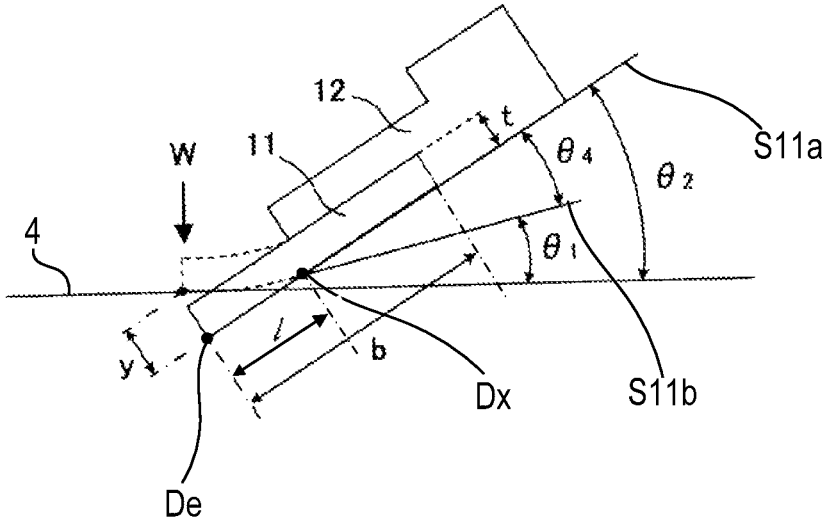
FIGS. 3A and 3B schematically illustrate a relations between a cleaning blade and a photosensitive drum according to the first embodiment.

FIG. 3A schematically illustrates a relation between the cleaning blade 11 and the photosensitive drum 4. The cleaning blade 11 has a rectangular cross-sectional shape in a plane perpendicular to the longitudinal direction (the axial direction of the photosensitive drum 4), and the angular portion 110 (the tip portion) is in contact with the photosensitive drum 4.

The cleaning angle $\theta_1$ of the cleaning blade 11 to the photosensitive drum 4 is, for example, 10 to 15°. The cleaning angle $\theta_1$ is obtained as follows.

In FIG. 3A, the angle (initial setting pressure contact angle) between the tangential direction of the surface of the photosensitive drum 4 at the contact point of the photosensitive drum 4 and the cleaning blade 11 and the generating line direction S11*a* of the cleaning blade 11 is defined as $\theta_2$. Further, the cleaning blade 11 is elastically deformed when pressed against the surface of the photosensitive drum 4. The angle (blade displacement angle) that is defined between the tangential direction S11*b* at the deformation starting point Dx and the generating line direction S11*a* of the cleaning blade 11 is defined as $\theta_4$. (see Eg. 1 for the calculation). The angle obtained by subtracting the blade displacement angle $\theta_4$ from the initial setting pressure contact angle $\theta_2$ is a cleaning angle $\theta_1$ ($=\theta_2-\theta_4$).

Further, the linear pressure W (pressing force) that presses the cleaning blade 11 against the surface of the photosensitive drum 4 is, for example, 12 to 24 gf/cm. Here, among the cleaning blade 11, the portion protruded from the holder 12 toward the photosensitive drum 4 is referred to as a free end, and the length of the free end will be referred to as a free end length "l." The push-in amount to the photosensitive drum 4 of the cleaning blade 11 is defined as "y." The blade displacement angle $\theta_4$ indicates a deformed degree of the blade, and can be obtained using the free end length l and the push-in amount y as follows.

$$\theta_4 = \frac{3 \times y}{2 \times l} \quad \text{[Eq. 1]}$$

Herein, the free end length "l" is measured from the leading edge De of the blade 11 to the deformation starting point Dx along the surface S11*a*. The push-in amount "y" is measured as a height of the leading edge De of the surface S11*a* in the perpendicular direction with respect to the surface S11*a*.

When the entire length of the cleaning blade 11 is "b" (mm), and the thickness thereof is "t" (mm), the second moment of area of the cleaning blade 11 can be expressed as follows:

$$I = \frac{b \times t^3}{12} \quad \text{[Eq. 2]}$$

Further, when the Young's modulus of the cleaning blade 44 is E (gf/mm$^2$), the pressing force W (linear pressure) for pressing the cleaning blade 11 against the surface of the photosensitive drum 4 can be expressed as follows:

$$W = \frac{3 \times E \times I \times y}{b \times L^3} = \frac{E \times t^3 \times y}{4 \times l^3} \quad \text{[Eq. 3]}$$

Here, the free end length l and the push-in amount y are set based on the Young's modulus E of the cleaning blade 11 so that the linear pressure W ranges from, for example, 12 to 24 gf/cm. The aforementioned deformation starting point Dx of the cleaning blade 11 is a starting position of the free end of the cleaning blade 11 (that is, the protrusion starting position from the holder 12).

Figure 3B:
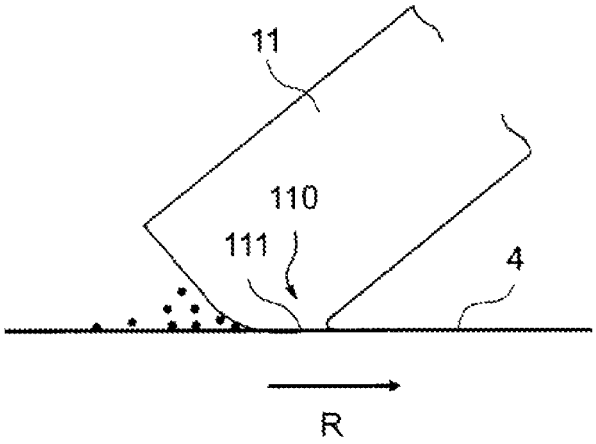

FIG. 3B schematically illustrates a contact state between the cleaning blade 11 and the photosensitive drum 4. The cleaning blade 11 plastically deforms when the corner portion 110 is pressed against the surface of the photosensitive drum 4 to form a blade nip 111. When the photosensitive drum 4 rotates in the arrow R direction shown in FIG. 3B, the blade nip 111 repeats a motion (stick-slip motion) in which the blade nip 11 deforms so as to be extended in the rotation direction of the photosensitive drum 4 and returns to the original position by the elastic force. With this, the toner, etc., remained on the surface of the photosensitive drum 4 is scraped off like being flicked. The stick-slip motion will be explained later.

<Toner>

In the image forming apparatus 100 of this embodiment, a non-magnetic one-component developer is used. The toner is a polymerized toner, and the mean particle diameter is, for example, 7.38 μm. The toner includes a mother particle containing at least a resin and a coloring agent, and an external additive to be added (externally added) to the surface of the mother particle. The mother particle is manufactured by an emulsion polymerization method. The mean particle diameter of the external additive is 5 to 400 nm. Further, the additive amount of the external additive to the mother particle of 100 parts by weight is preferably 0.5 to 8.0 parts by weight, more preferably 1.5 to 6.0 parts by weight, still more preferably 1.5 to 5.0 parts by weight.

The toner of this embodiment includes melamine, mid-sized silica, organic fine particles, and silica spacers as an external additive. The mean particle diameter of the melamine is 100 to 300 nm, and the mean particle diameter of the mid-sized silica is 5 to 40 nm. The mean particle diameter of the organic fine particle is 100 to 400 nm, and the mean particle diameter of the silica spacer is 100 nm. The aforementioned content (parts by weight) of the external additive can be obtained from the ratio of the spectral intensity obtained by analyzing the composition of the toner using an energy dispersive X-ray spectroscolpy (EDX) or FT-IR to the spectral intensity when an external additive is added only by a known parts by weight. The ratio of the spectral intensity and the content (parts by weight) is in a proportional relation.

<Control System>

Next, the control system of the image forming apparatus 100 will be explained. FIG. 4 is a block diagram showing the control system of the image forming apparatus 100. The image forming apparatus 100 is equipped with a controller 70, an I/F (interface) controller 71, a receive memory 72, an image data editing memory 73, a panel section 90, an operation key section 91, and sensors 92 (including a density sensor 93).

The controller 70 is constituted by, a microprocessor, a ROM (Read Only Memory), a RAM (Random Access Memory), an input/output port, a timer, etc. The controller 70, for example, receives print data and control commands from a host device such as a personal computer, etc., via an I/F controller 71 and performs a printing operation (image formation) of the image forming apparatus 100.

The I/F controller 71 transmits the information (printer information) of the image forming apparatus 100 to a host device, analyzes commands received from the higher-level device, and processes the data received from the host device.

The receive memory 72 temporarily stores the print data input from the high-level device via the I/F controller 71 every color. The image data editing memory 73 edits the print data temporarily stored in the receive memory 72 and stores. The panel section 90 has a display section (e.g., LED) for displaying the status of the image forming apparatus 100. The operation key section 91 is a section for inputting an instruction to the image forming apparatus 100 by an operator.

The sensor 92 includes various sensors for monitoring the operating state of the image forming apparatus 100, such as a plurality of medium position sensors (traveling sensors) for detecting the carry position of the recording medium 41, a temperature and humidity sensor, a density sensor 93 for measuring a density, etc. The output of the sensor 92 is input to the controller 70.

The image forming apparatus 100 also includes charge voltage controllers 74K, 74Y, 74M, 74C (C. Volt. Controllers), head controllers 75K, 75Y, 75M, 75C, development voltage controllers 76K, 76Y, 76M, 76C, blade voltage controllers 77K, 77Y, 77M, 77C, supply voltage controllers 78K, 78Y, 78M, 78C (S. Volt. Controllers), transfer voltage controllers 79K, 79Y, 79M, 79C, image forming drive controllers 80K, 80Y, 80M, 80C, a carrying controller 81, a belt drive controller 82, and a fuse controller 83.

The charge voltage controller 74K, 74Y, 74M, 74C controls applying a charge voltage for evenly charging the surface of the photosensitive drum 4K, 4Y, 4M, 4C to the charge roller 5K, 5Y, 5M, 5C by the instruction of the controller 70.

The head controller 75K, 75Y, 75M, 75C performs a light-emitting control of the exposure head 3K, 3Y, 3M, 3C to expose the surface of the photosensitive drum 4K, 4Y, 4M, 4C based on the image data of each color recorded in the image data editing memory 73 in accordance with the instruction of the controller 70.

The development voltage controller 76K, 76Y, 76M, 76C (D. Volt. Controllers) controls application of the development voltage for developing the electrostatic latent image on the surface of the photosensitive drum 4K, 4Y, 4M, 4C to the development roller 6K, 6Y, 6M, 6C (Develop. Rollers) in accordance with the instruction of the controller 70.

The blade voltage controller 77K, 77Y, 77M, 77C (B. Volt. Controllers) controls application of a blade voltage for controlling the charge amount of the toner on the development roller 6K, 6Y, 6M, 6C to the development blade 8K, 8Y, 8M, 8C (Develop. Blades) in accordance with the instruction of the controller 70.

The supply voltage controller 78K, 78Y, 78M, 78C controls application of the supply voltage for supplying the toner to the development roller 6K, 6Y, 6M, 6C to the supply roller 9K, 9Y, 9M, 9C in accordance with the controller 70.

The transfer voltage controller 79K, 79Y, 79M, 79C (T. Volt. Controllers) controls application of the transfer voltage for transferring the toner image of the photosensitive drum 4K, 4Y, 4M, 4C to the recording medium 41 to the transfer roller 10K, 10Y, 10M, 10C in accordance with the instruction of the controller 70.

The image forming drive controller 80K, 80Y, 80M, 80C (IFD Controllers) controls rotational driving of the drive motor 84K, 84Y, 84M, 84C, which is a drive source of the image forming unit 1K, 1Y, 1M, 1C in accordance with the instruction of the controller 70. The rotation of the drive motor 84K, 84Y, 84M, 84C is transmitted to the photosensitive drum 4K, 4Y, 4M, 4C, the development roller 6K, 6Y, 6M, 6C and the supply roller 9K, 9Y, 9M, 9C. Further, the charge roller 5K, 5Y, 5M, 5C rotates in accordance with the photosensitive drum 4K, 4Y, 4M, 4C.

The carry controller 81 controls driving of the carry motor 85 for rotatably driving each roller (hopping roller 40, the registration roller pair 44, 45, and the carrying roller 46, 47) for feeding/carrying the recording medium 41 and the clutch, which is not illustrated, in accordance with the instruction of the controller 70.

The belt drive controller 82 controls driving of the belt motor 86 for rotatably driving the belt driving roller 17 for driving the carrying belt 18 in accordance with the instruction of the controller 70.

The fusion controller 83 performs on-off control of the heater 87 embedded in the fuser roller 19 based on the temperature detected by the thermistor 88 provided in the fuser device 50 in accordance with the instruction of the controller 70 to keep the surface temperature of the fuser roller 19 constant. He The fusion controller 83 further controls driving of the fusion motor 89 for rotatably driving the fuser roller 19 (in a state in which the fuser device 50 has raised in temperature to a predetermined temperature). The rotation of the fusion motor 89 is also transmitted to the ejection rollers 48, 49. Further, the fuser backup roller 20 rotates in accordance with the rotation of the fuser roller 19.

In cases where a raising and lowering mechanism (up-down mechanism) for raising and lowering the image forming unit 1K, 1Y, 1M, 1C is provided, a raising and lowering controller for driving the raising and lowering motor (up-down motor) for driving the raising and lowering mechanism is provided.

<Operation of Image Forming Apparatus>

Next, the basic operation of the image forming apparatus 100 will be explained with reference to FIGS. 1 and 4. The controller 70 of the image forming apparatus 100 starts the printing operation (image formation) upon receipt of the print command and the print data via the I/F controller 71 from the host device. The controller 70 temporarily stores the print data in the receive memory 72, creates image data by editing processing the stored print data, and records the image data in the image data editing memory 73.

The controller 70 also drives the carry motor 85 by the carry controller 81. With this, the hopping roller 40 rotates to feed the recording medium 41 stored in the sheet feeding cassette 43 one by one to the medium carrying path 42. Further, the registration roller pair 44, 45 start rotation at a predetermined timing to carry the recording medium 41 to the carrying roller pair 46, 47 while correcting the skew of the recording medium 41. Further, the carrying roller pair 46, 47 carries the recording medium 41 to the carrying belt 18 along the medium carrying path 42.

The carrying belt 18 travels in accordance with the rotation of the belt driving roller 17, and carries the recording medium 41 to the image forming units 1K, 1Y, 1M, 1C in this order while absorbing the recording medium 41.

The controller 70 performs formation of a toner image of each color in the image forming unit 1K, 1Y, 1M, 1C. That is, by the charge voltage controller 74K, 74Y, 74M, 74C, the development voltage controller 76K, 76Y, 76M, 76C, the blade voltage controller 77K, 77Y, 77M, 77C, and the supply voltage controller 78K, 78Y, 78M, 78C, a charge voltage, a development voltage, a blade voltage, and a supply voltage are respectively applied to the charge roller 5K, 5Y, 5M, 5C, the development roller 6K, 6Y, 6M, 6C, the development blade 8K, 8Y, 8M, 8C, and the supply roller 9K, 9Y, 9M, 9C.

The controller 70 also drives the drive motor 84K, 84Y, 84M, 84C by the image forming drive controller 80K, 80Y, 80M, 80C to rotate the photosensitive drum 4K, 4Y, 4M, 4C. In accordance with the rotation of the photosensitive drum 4K, 4Y, 4M, 4C, the charge roller 5K, 5Y, 5M, 5C, the development roller 6K, 6Y, 6M, 6C, and the supply roller 9K, 9Y, 9M, 9C rotates. The charge roller 5K, 5Y, 5M, 5C evenly charges the surface of the photosensitive drum 4K, 4Y, 4M, 4C.

The controller 70 further performs a light-emitting control of the head controller 75K, 75Y, 75M, 75C based on the image data recorded in the image data editing memory 73. The head controller 75K, 75Y, 75M, 75C irradiates a light onto the surface of the photosensitive drum 4K, 4Y, 4M, 4C from the exposure head 3K, 3Y, 3M, 3C to form an electrostatic latent image.

The electrostatic latent image formed on the surface of the photosensitive drum 4K, 4Y, 4M,C is developed by the toner adhered to the development roller 6K, 6Y, 6M, 6C, and therefore a toner image is formed on the surface of the photosensitive drum 4K, 4Y, 4M, 4C. When the toner image approaches the surface of the carrying belt 18 in accordance with the rotation of the photosensitive drum 4K, 4Y, 4M, 4C, the transfer voltage controller 79K, 79Y, 79M, 79C applies a transfer voltage to the transfer roller 10K, 10Y, 10M, 10C. With this, the toner image formed on the surface of the photosensitive drum 4K, 4Y, 4M, 4C is transferred to the recording medium 41 on the carrying belt 18.

Among toners on the surface of the photosensitive drum 4K, 4Y, 4M, 4C, the toner which has not been transferred to the recording medium 41 is scrapped off by the cleaning blade 11K, 11Y, 11M, 11C.

As explained above, the toner image of each color formed by the image forming unit 1K, 1Y, 1M, 1C is transferred to the recording medium 41 sequentially, and interposed each other. The recording medium 41 to which a toner image of each color is transferred is further carried by the carrying belt 18, and reaches the fuser device 50.

In the fuser device 50, the recording medium 41 is introduced into a nip pair between the fuser roller 19 and the fuser backup roller 20. The recording medium 41 is pressurized and heated by the nip pair between the fuser roller 19 and the fuser backup roller 20, so that toner image is fused to the recording medium 41.

The recording medium 41 on which the toner image was fused is ejected by the election rollers 48, 49 to the outside of the image forming apparatus 100, and stacked on the stacker part 103. With this, the formation of the color image on the recording medium 41 is completed.

<Function of Cleaning Blade>

As explained above, the cleaning blade 11 (11K, 11Y, 11M, 11C) is in contact with the surface of the photosensitive drum 4 (4K, 4Y, 4M, 4C) to scrap off the transfer residual toner adhered to the surface of the photosensitive drum 4.

Figure 5A:
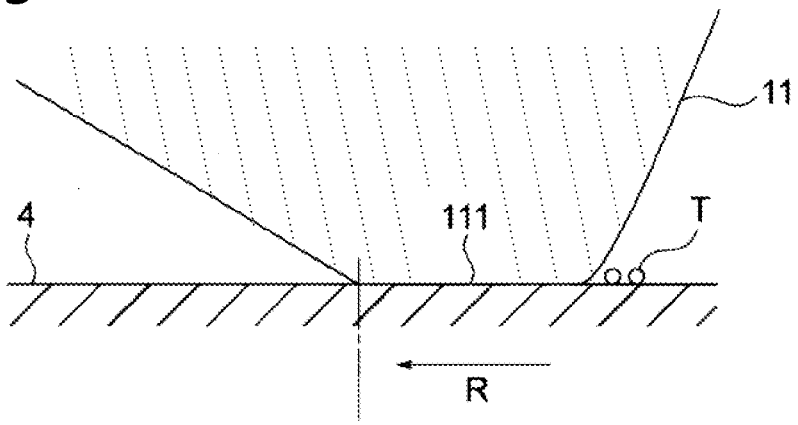
FIGS. 5A-5C illustrate stick-slip motions of the cleaning blade.
Figure 5B:
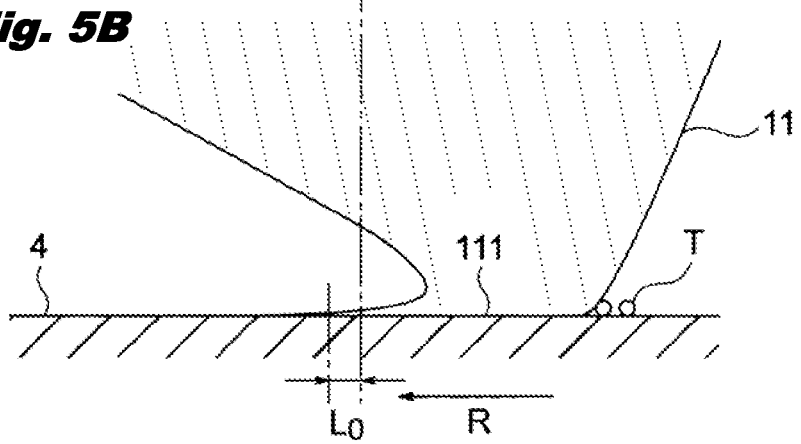
Figure 5C:
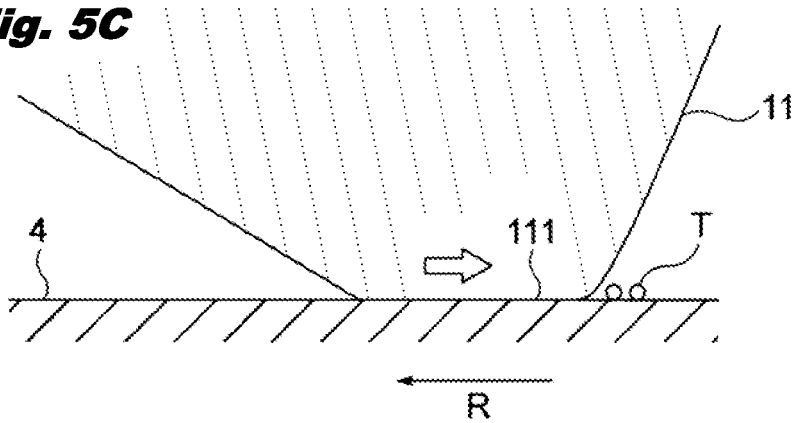

FIGS. 5A to 5C are schematic drawings for explaining a stick-slip motion which occurs at the contact portion between the cleaning blade 11 and the photosensitive drum 4. In FIG. 5, for the convenience of explanation, the surface of the photosensitive drum 4 is shown as a horizontal plane.

As explained above, in the cleaning blade 11, the corner portion 110 is pressed against the surface of the photosensitive drum 4. As shown in FIG. 5A, at the portion where the cleaning blade 11 is in contact with the surface of the photosensitive drum 4, a blade nip 111 along the surface of the photosensitive drum 4 is formed.

When the photosensitive drum 4 rotates and the surface of the photosensitive drum 4 moves in the direction shown by the arrow R, the blade nip 111 deforms as shown in FIG. 5B, and is extended in the moving direction of the surface of the photosensitive drum 4. As the blade nip 111 is extended, the elastic force of the cleaning blade 11 increases. When the static frictional force between the cleaning blade 11 and the surface of the photosensitive drum 4 and the elastic force of the cleaning blade 11 are balanced, the blade nip 111 slips with respect to the surface of the photosensitive drum 4. The coefficient of dynamic friction is smaller than the coefficient of static friction, and therefore the blade nip 111 returns to the original position while slipping on the surface of the photosensitive drum 4 as shown in FIG. 5C.

The cleaning blade 11 repeats the motion (stick-slip motion) in which the cleaning blade 11 deforms in the moving direction of the surface of the photosensitive drum 4 and then returns to its original shape by the elastic force (restoring force), to thereby scrap off the toner T adhered to the surface of the photosensitive drum 4. Accordingly, the cleaning performance of the cleaning blade 11 is affected by the skip-slip motion property.

In recent image forming apparatuses, for the purpose of increasing image quality and speeding up, reducing the particle diameter of a toner and lowering the fusing point of a toner are being progressed. A toner small in particle diameter and low in fusing point tends to contain a large amount of external additives (silica fine particles, charge control agents, etc.). This is because it is necessary to increase the amount of the charge control agent contained in the toner so that the toner is charged in a short time to stabilize the toner charging. When the amount of external additives increases as mentioned above, the external additives is likely to pass through between the cleaning blade 11 and the surface of the photosensitive drum 4 and adhere to the surface of the charge roller 5, which may affect the image formation.

Further, it is necessary to consider that the image forming apparatus 100 is used under any environments from a low temperature/low humidity environment to a high temperature/high humidity environment. The cleaning blade 11 is formed by urethane rubber, etc., and therefore there is a possibility that the rubber property changes depending on the operating temperature and the passing of external additive may occur under a high temperature/high humidity environment even if no passing of the external additive occurs under a normal office environment.

In this embodiment, in order to suppress the passing of external additive, it is configured to cause an appropriate stick-slip motion of the cleaning blade 11.

Again referring to FIGS. 5A to 5C, in FIG. 5A, the toner T, etc., (including external additives separated from the toner T, and paper powder) adhering to the surface of the photosensitive drum 4 is held back by the cleaning blade 11, and forms a stationary region (toner stagnation in the case of a toner T) at the vicinity of the blade nip 111.

In the process from FIG. 5A to FIG. 5B, i.e., the stick movement, the toner T, etc., existing in the blade nip 111 and the stationary region moves together with the surface of the photosensitive drum 4.

In the process from FIG. 5B to FIG. 5C, i.e., in the slip movement, the toner T, etc., existing in the blade nip 111 and the stationary region is pushed back in a direction opposite to the moving direction of the surface of the photosensitive drum 4 by the elastic force of the cleaning blade 11. At this time, the toner T, etc., is scraped from the surface of the photosensitive drum 4 like being flicked by the cleaning blade 11.

On the other hand, during this stick-slip motion, in the stationary region, the toner T repeatedly receives friction between the cleaning blade 11 and the photosensitive drum 4. By this friction, there is a possibility that the external additive is exfoliated (detached) from the toner T.

Especially, in the case of using toner containing a large amount of external additive as mentioned above, the amount of external additive detached from the toner increases. Therefore, the amount of external additive which reaches between (blade nip 111 and the stationary region) the cleaning blade 11 and the photosensitive drum 4 also increases. As a result, the passing of the external additive further readily occurs.

So in this embodiment, in order to prevent the passing of external additive by controlling the stick-slip motion of the cleaning blade 11, the loss elastic modulus E" (E double prime) of the cleaning blade 11 is controlled. The loss elastic modulus shows a loss of mechanical energy. Generally, it is an index showing a flexibility of a sample.

<Experimental Method and Experimental Results>

Initially, an experiment of investigating changes of generation state of passing of external additive was performed while changing a loss elastic modulus E" of the cleaning blade 11. Here, eight types of cleaning blades 11 different in loss elastic modulus E" were formed. The loss elastic modulus E" of the cleaning blade 11 was adjusted by adjusting the humidity (environmental humidity) at the time of executing vulcanization of the urethane rubber in the production process of the cleaning blade 11. As the humidity at the time of vulcanization decrease, the loss elastic modulus E" increases, and as the humidity increases, the loss elastic modulus E" decreases.

The loss elastic modulus E" of the cleaning blade 11 was measured using "Viscoelasticity measuring instrument DMS6100" made by Hitachi High-Technologies Corporation. The measurement was performed at a temperature of 100° C. and at a frequency of 10 Hz. Further, the rate of temperature rise was set to 2° C./min. The loss elastic modulus E" of the loss elastic modulus cleaning blade 11 can be measured at the temperature range of −30° C. to +150° C., but in this Example, the measured value at the temperature 100° C. was used.

The reason that the measured value of the loss elastic modulus E" at the temperature of 100° C. was used was that the passing of external additive readily occurs at a temperature higher than a normal temperature. Further, the stress relaxation behavior of the viscoelastic material gradually progresses from the moment of giving a stress, and requires a long period of time until it reaches the completion. As to the measurement of the dynamic viscoelasticity, there is a relation called "time temperature conservation law", and the viscosity measured over a long period of time and the viscosity measured under a high temperature become equal. For this reason, using the measured value at a temperature of 100° C., it becomes possible to measure the dynamic viscoelasticity considered the stress relaxation behavior over a long period of time.

The eight types of cleaning blades 11 produced as mentioned above were attached to the image forming apparatus 100 and printing tests were performed respectively. In the printing test, after leaving the image forming apparatus 100 in the environment of a temperature of 28° C. and a relative humidity of 80% for 12 hours, in the same environment, a print pattern in which the duty ratio was 20% was continuously printed 72,000 sides (36,000 sheets) on both sides of a letter sized print sheet.

As the image forming apparatus 100, a "black and white printer B731" made by Oki Data Corporation was used. The black and white printer used in this printing test was a printer having one image forming unit (image forming unit 1) among four image forming units 1K, 1Y, 1M and 1C of the image forming apparatus 100 shown in FIG. 1.

The cleaning angle θ1 (FIG. 3A) of the cleaning blade 11 with respect to the photosensitive drum 4 was set to 10°, and the processing force (linear pressure) W was set to 12 gf/cm. The Vickers hardness (which will be explained later) of the photosensitive drum 4 was set to 8 N/mm$^2$ The charge voltage was set to −950 V, the development voltage was set to −200 V, the supply voltage was set to −300 V, and the transfer voltage was set to +2,000 V. These voltages were voltages at the time of performing the printing tests, and the applied voltages for the printing operation of the image forming apparatus of this embodiment are not limited to these voltages. This is also applied to the following experiments.

After completion of the continuous printings of 72,000 sides, the existence or non-existence of the external additive adhesion was judged by visually observing the surface of the charge roller 5 of the image forming unit 1 of the printer. Since the surface of the charge roller 5 is dark, when an external additive is adhered, the surface looks blurry white.

Figure 6:
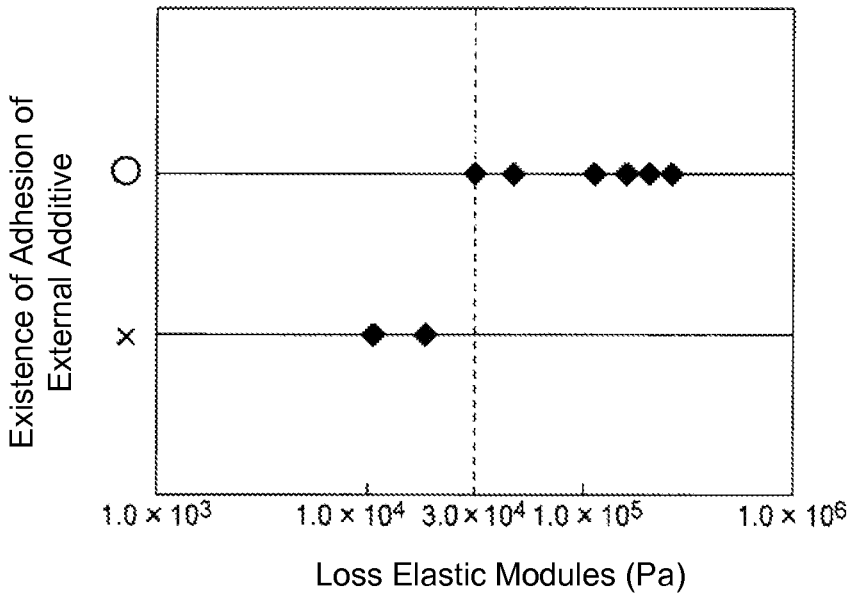
FIG. 6 is a graph showing a relation between a loss elastic modulus of the cleaning blade and an existence or non-existence of adhesion of an external additive on a surface of a charge roller.

The relation between the loss elastic modulus E" of the cleaning blade 11 at the temperature 100° C. and the frequency 10 Hz and the existence or non-existence of external additive adhesion on the surface of the charge roller 5 is shown in Table 1. Further, the results in Table 1 also are shown in the graph of FIG. 6. In FIG. 6, the horizontal axis shows a loss elastic modulus E" (Pa), and the vertical axis shows an existence or non-existence of external additive adherence. In Table 1 and FIG. 6, the case in which adhesion of external additive was observed on the surface of the charge roller 5 is denoted as x, and the case in which no adhesion was observed is denoted as ○.

TABLE 1

| Loss elastic modulus (Pa) | Existence or non-existence of adhesion of external additive |
|---|---|
| 10,408 | X |
| 18,408 | X |
| 29,944 | ○ |
| 47,706 | ○ |
| 101,302 | ○ |
| 113,048 | ○ |

TABLE 1-continued

| Loss elastic modulus (Pa) | Existence or non-existence of adhesion of external additive |
|---|---|
| 200,625 | ○ |
| 260,705 | ○ |

From Table 1 and FIG. 6, it is understood that, in cases where the loss elastic modulus E" is $3.00\times10^4$ Pa or more at a temperature of 100° C. and frequency 10 Hz, no adhesion of external additive on the surface of the charge roller 5 occurs (i.e., passing of external additive is controlled).

The reason that the passing of external additive can be controlled by increasing the loss elastic modulus E" of the cleaning blade 11 is considered as follows. As shown in FIGS. 5A and 5B, the amount of displacement of the cleaning blade 11 in accordance with the movement of the surface of the photosensitive drum 4 is denoted as a stick-slip distance $L_0$. This stick-slip distance $L_0$ is expressed by the following equation (1) by the Maxwell model.

[Eq. 4]

$$L_o = \frac{(\mu_s - \mu_k - \mu_\delta)W}{E} + v\tau\ln\frac{(\mu_s - \mu_k)}{\mu_\delta} \quad (1)$$

wherein $\mu_s$ is a coefficient of static friction, $\mu_k$ is a coefficient of dynamic friction, $\mu_o$ is a coefficient of friction of the increment of the frictional force when the kinetic friction force and the spring force is balanced. Further, W is a load and E is a complex modulus. ν is a circumferential velocity of the photosensitive drum 4, and τ is a relaxation time.

Further, the loss elastic modulus E" is a viscosity component and can be expressed by the following equation (2).

[Eq. 5]

$$E'' = \eta'\omega \quad (2)$$

where ω is a frequency of vibration, and η' is a dynamic viscosity coefficient. The loss elastic modulus E" is a viscous component and a function of the dynamic viscosity coefficient as shown in Equation (2).

Further, the relaxation timer τ can be expressed by the following equation (3).

[Eq. 6]

$$\tau = \frac{\eta}{E} \quad (3)$$

where η is a viscosity coefficient, and E is an elastic modulus.

The Equation (3) means that the longer the relaxation timer τ is, the contribution of the viscosity becomes larger than the elasticity in the viscoelastic characteristic. That is, the longer the relaxation time τ is, the more the contribution of the viscosity is than elasticity. Accordingly, as shown in the Equation (2), it is considered that the loss elastic modulus E" which is a function of the coefficient of the dynamic viscosity becomes larger. In other words, it is considered that as the loss elastic modulus E" increases, the relaxation time τ extends, and as the loss elastic modulus E" decreases, the relaxation time τ becomes short.

Therefore, from the Equation (1), it can be considered that the larger the loss elastic modulus E" is (i.e., the longer the relaxation time τ is), the longer the stick-slip distance $L_0$) is. As the stick-slip distance $L_0$ increases, the cycle (oscillation cycle) of the stick-slip motion of the cleaning blade 11 increases.

When the cycle (oscillation cycle) of the stick-slip motion is short, a minute gap is likely generated between the cleaning blade 11 and the photosensitive drum 4, which readily causes passing of the external additive. On the other hand, when the stick-slip distance $L_0$ is increased (by increasing the loss elastic modulus E") as mentioned above, a minute gap less likely occurs between the cleaning blade 11 and the photosensitive drum 4, the event probability of passing of external additive per unit time can be controlled. With this, as shown in Table 1 and FIG. 6, it can be considered that the generation of passing of external additive could be controlled by increasing the loss elastic modulus E".

On the other hand, when the loss elastic modulus E" exceeds $2.61\times10^5$ Pa, the stick-slip distance $L_0$ is extended, which in turn less likely occurs a stick-slip motion. Therefore, the scraping effects of scraping the toner T by the slip motion of the cleaning blade 11 explained with reference with FIG. 5C deteriorates, resulting in a deterioration of the cleaning performance. Further, the loss elastic modulus E" of the cleaning blade 11 is adjusted by the humidity at the time of vulcanization of the urethane rubber as mentioned above. However, the adjustment by lowering the humidity has a limit, and the creating of the cleaning blade 11 in which the loss elastic modulus E" exceeds $2.61\times10^5$ Pa is difficult.

From the above, in this embodiment, by setting the loss elastic modulus E" of the cleaning blade 11 at a temperature of 100° C. and a frequency of 10 Hz to the range of $3.00\times10^4$ Pa to $2.61\times10^5$ Pa, effects of suppressing of the passing of external additive of the toner (adhesion to the charge roller 5) and improving the image quality have been attained.

Next, experiments in which the Vickers hardness of the surface of the photosensitive drum 4 is changed to investigate the change of generation state of passing of external additive was performed. Here, six types of photosensitive drums 4 different in Vickers hardness of the surface were created. The Vickers hardness of the surface of the photosensitive drum 4 was adjusted by adjusting the drying time at the time of forming the outermost external peripheral side layer (i.e., the charge transportation layer) of the photosensitive drum 4 by the immersion treatment.

The Vickers hardness was measured by pressing an indenter (indenter) against the surface of the photosensitive drum 4 using a micro-hardness tester ⌈Nano Indenter G200⌋ (made by Agilent Technologies Corporation). The measurement environment was set to a temperature of 25° C. and a relative humidity of 50%.

The six types of photosensitive drums 4 produced as mentioned above were respectively subjected to printing tests by attaching to the image forming apparatus 100. In the printing test, after leaving the image forming apparatus 100 in the environment of a temperature of 28° C. and a relative humidity of 80% for 12 hours, in the same environment a print patter in which the duty ration was 20% was continuously printed by 72,000 sides (36,000 sheets) on both surfaces of a print sheet of a letter size.

As the image forming apparatus 100, a "black and white printer B731" made by Oki Data Corporation was used. The cleaning angle θ1 of the cleaning blade 11 with respect to the photosensitive drum 4 was set to 10°, and the processing force (linear pressure) W was set to 12 gf/cm. The cleaning blade 11 in which the loss elastic modulus E" was $1.85\times10^4$ Pa at a temperature of 100° C. and a frequency of 10 Hz was used.

The preferable range of the loss elastic module E" of the cleaning blade 11 is $3.00\times10^4$ Pa to $2.61\times10^5$ Pa. Considering that when the loss elastic modulus E" is small, the external additive passing more likely occurs, to perform the experiments under harder conditions, a cleaning blade 11 smaller in loss elastic modulus E" than the aforementioned preferable range was used.

After completion of the continuous printings of 72,000 sides, the degree of the external additive adhesion was judged by visually observing the surface of the charge roller 5 of the image forming unit 1 of the printer.

As to the degree of the external additive adhesion, the case in which the external additive adhesion on the surface of the charge roller 5 was not at all observed is shown by ◎, and the case in which the external additive adhesion on the surface of the charge roller 5 was observed, but was not appeared on the print image is shown by ○. Further, the case in which the external additive adhesion on the surface of the charge roller 5 was observed and appeared on the print image is shown by x.

Figure 7:
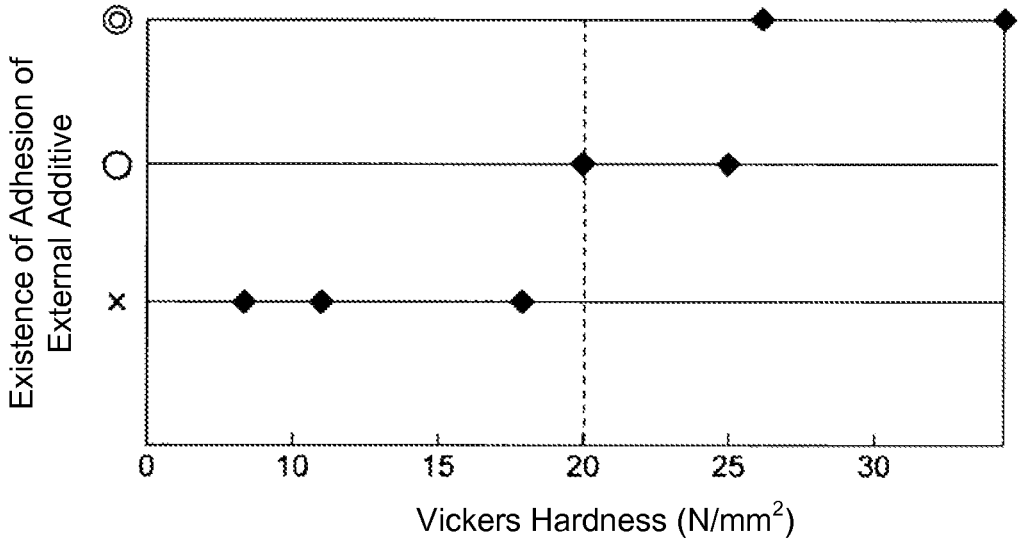
FIG. 7 is a graph showing a relation between a Vickers hardness of a surface of the photosensitive drum and a degree of adhesion of an external additive on the surface of the charge roller.

The relation between the Vickers hardness of the photosensitive drum 4 and the degree of the external additive adhesion on the surface of the charge roller 5 is shown in Table 2. Further, the results of Table 1 are also shown in the graph of FIG. 7. In FIG. 7, the horizontal axis shows a Vickers hardness ($N/mm^2$), and the vertical axis shows the degree of external additive adhesion.

TABLE 2

| Vickers hardness ($N/mm^2$) | Degree of external additive adhesion |
|---|---|
| 8.000 | X |
| 11.000 | X |
| 17.890 | X |
| 20.000 | ○ |
| 25.012 | ○ |
| 26.000 | ◎ |
| 35.000 | ◎ |

From Table 2 and FIG. 7, it is understood that, in cases where the Vickers hardness of the photosensitive drum 4 is 20 $N/mm^2$ or more, no adhesion of external additive on the surface of the charge roller 5 occurs (i.e., passing of external additive is controlled).

The reason that the passing of external additive can be controlled as the Vickers hardness on the surface of the photosensitive drum 4 becomes higher can be controlled is considered as follows. That is, when the Vickers hardness is low, dented portions are more likely formed on the surface of the photosensitive drum 4, and the external additive of the toner transferred from the development roller 6 to the surface of the photosensitive drum 4 is likely introduced in the dented portions. The external additive entered in the dented portion is not transferred to the recording medium 41 and remains on the surface of the photosensitive drum 4, and reaches the vicinity of the cleaning blade 11 in accordance with the rotation of the photosensitive drum 4. As a result, the amount of the blade nip 111 of the cleaning blade 11 and the amount of the external additive of the stationary region increase, which more likely occurs passing of the external additive. To the contrary, in cases where the Vickers hardness is high, dented portions are less likely formed on the surface of the photosensitive drum 4, and therefore the amount of external additive remaining on the surface of the photosensitive drum 4 is small. Accordingly, it is considered that the passing of external additive less likely occurs.

From the above, by setting the Vickers hardness of the surface of the photosensitive drum 4 to 20 N/mm$^2$ or more, it becomes possible to more effectively suppress the passing of external additive of the toner.

Next, experiments of investigating the change of the film scraped amount were performed while changing the Vickers hardness of the surface of the photosensitive drum 4. Here, six types of photosensitive drums 4 were formed, and printing tests (continuous printings on 72,000 sides) were performed under the same conditions. And, the outer diameter (30.00 mm) of the photosensitive drum 4 before the continuous printing, and the outer diameter thereof after the continuous printing were measured by a laser length measuring machine, and the difference thereof was divided by 2 to thereby obtain a decreased amount (referred to as "film scraped amount") of the film thickness of the photoreceptive layer. The film scraped amount was measured at several points of the photosensitive drum 4 in the axial direction, and the maximum value was used.

Figure 8:
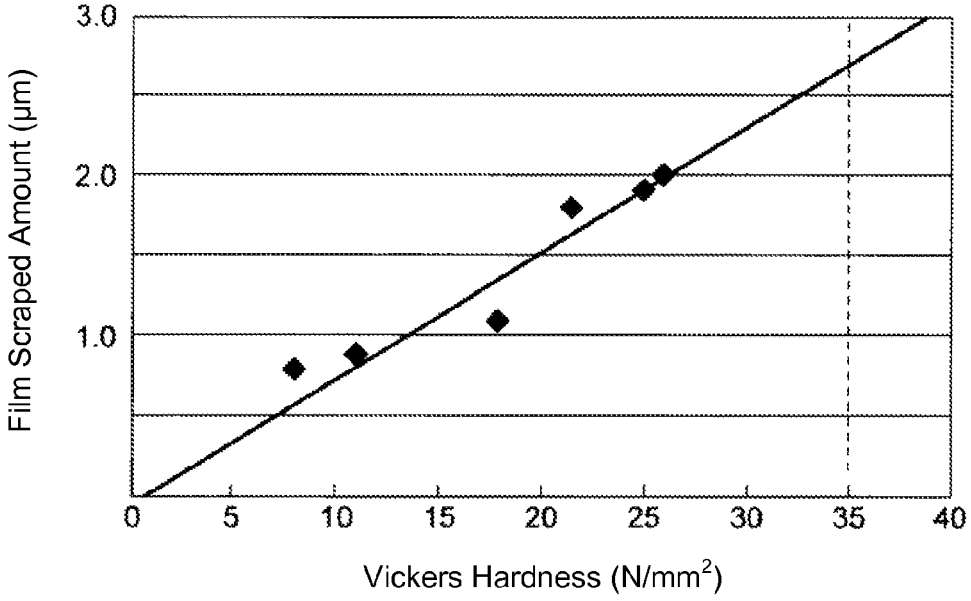
FIG. 8 is a graph showing a relation between a Vickers hardness of the surface of the photosensitive drum and a film scraped amount.

The relation between the Vickers hardness of the photosensitive drum 4 and the film scraped amount is shown in Table 3. Further, the results of Table 3 are also shown in the graph of FIG. 8. In FIG. 8, the horizontal axis shows a Vickers hardness (N/mm$^2$), and the vertical axis shows a film scraped amount (μm). The film scraped amount is a film scraped amount per 10,000 sides obtained by measuring a film thickness before and after the continuous printing of 72,000 sides and calculating from the reduced amount of the outer diameter of the photosensitive drum 4.

TABLE 3

| Vickers hardness (N/mm$^2$) | Film scraped amount (μm)/10K |
|---|---|
| 8.000 | 0.8 |
| 11.000 | 0.9 |
| 17.890 | 1.1 |
| 21.726 | 1.8 |
| 25.012 | 1.9 |
| 26.000 | 2.0 |

From the results shown in Table 3 and FIG. 8, it is understood that the Vickers hardness of the surface of the photosensitive drum 4 increases, the film scraped amount of the surface of the photosensitive drum 4 increases.

When the Vickers hardness of the surface of the photosensitive drum 4 exceeds 35 N/mm$^2$, the surface of the photosensitive drum 4 is too hard, which increases the film scraped amount and decreases the film thickness. This causes a charge failure on the surface of the photosensitive drum 4, resulting in an image forming deficiency such as scumming (phenomenon in which toner adheres to an outside of a non-printing region). For this reason, it is preferable that the Vickers hardness of the surface of the photosensitive drum 4 is 35 N/mm$^2$ or less.

It is difficult to set the Vickers hardness of the surface of the photosensitive drum 4 to be less than 8 N/mm$^2$ in terms of production, and therefore photosensitive drums 4 having a surface Vickers hardness of 8 N/mm$^2$ or more were subjected to experiments.

As mentioned above, by setting the Vickers hardness of the surface of the photosensitive drum 4 so as to fall within a range of 8 N/mm$^2$ to 35 N/mm$^2$, image forming deficiency such as, e.g., scumming can be suppressed. Further, by setting the Vickers hardness of the surface of the photosensitive drum 4 so as to fall within a range of 20 N/mm$^2$ to 35 N/mm$^2$, it becomes possible to reduce the likelihood of occurrence of irregularities of the surface of the photosensitive drum 4 and more effectively suppress the passing of external additive of the toner.

The aforementioned each experiment of this embodiment was performed by setting the charge voltage to −950 V, the development voltage to −200 V, the supply voltage to −300 V, and the transfer voltage to +2,000 V. However, if the charge voltage is within a range of −400 V to −1,200 V in charge voltage, −50 V to −300 V in development voltage, −2,000 V to −4,000 V in supply voltage, and +1,500 V to +2,500 V, the same effects can be obtained.

Effects of First Embodiment

As explained above, in the first embodiment of the present invention, by setting the loss elastic modulus E" of the cleaning blade 11 at a temperature of 100° C. and a frequency of 10 Hz so as to fall within a range of $3.00\times10^4$ Pa to $2.61\times10^5$ Pa, passing of external additive of the toner (developer) can be suppressed and a good image can be formed.

In addition, by setting the Vickers hardness of the surface of the photosensitive drum 4 to a range of 8 N/mm$^2$ to 35 N/mm$^2$, it becomes possible to suppress the image forming deficiency such as, e.g., scumming. Further, by setting the Vickers hardness to a range of 20 N/mm$^2$ to 35 N/mm$^2$, it is possible to effectively suppress passing of external additive.

Second Embodiment

Next, a second embodiment of the present invention will be explained. The structure of the image forming apparatus 100 and that of the image forming unit 1 according to the second embodiment are the same as that of the first embodiment (FIGS. 1 and 2).

In the aforementioned first embodiment, by defining the range of loss elastic modulus E" of the cleaning blade 11 at a temperature of 100° C. and a frequency of 10 Hz, passing of external additive is suppressed, and further the preferable range of the Vickers hardness of the surface of the photosensitive drum 4 was defined. However, in this embodiment, by setting the preferable range of the surface free energy of the photosensitive drum 4, the image quality has been improved.

The surface free energy denotes an amount of work required to create a surface. A surface of a sold substance is in a state in which the intermolecular bond is cut, and therefore an energy required to cut the intermolecular bond is accumulated on the surface. Among substances, since molecules are pulled each other to be condensed, the photosensitive drum 4 and the toner T, or the photosensitive drum 4 and the external additive are pulled each other. Therefore, the higher the surface free energy of the photosensitive drum 4 is, the stronger the adhesion of particles adhered to the surface becomes. As a result, it becomes difficult to control passing of the external additive through the cleaning blade.

Initially, experiments of investigating the change of print density were performed while changing the surface free energy of the photosensitive drum 4. Here, ten types of photosensitive drums 4 different in surface free energy were created. The surface free energy was adjusted by adjusting the drying time at the time of forming the outermost external peripheral side layer (i.e., the charge transportation layer) of the photosensitive drum 4 by the immersion treatment.

The surface free energy was calculated by a Zisman method. Here, as the three types of solvents in which the surface tension is known, water ($H_2O$), polyethylene glycol (PEG) 200, and n-dodecane were used. Each medium was dropped on the surface of the photosensitive drum 4, and each contact angle α was measured. When the surface tension of each solvent is shown on the X-axis and the cos α is shown on the Y-axis, and a surface free energy (mN/m) was obtained from the value on the X-axis intersecting a straight line obtained from three points corresponding to each solvent with Y=1 (α=0). The measurement environment was set to a temperature of 22° C. and a relative humidity of 50%.

The ten types of photosensitive drums 4 produced as mentioned above were respectively subjected to printing tests by attaching to the image forming apparatus 100. In the printing test, after leaving the image forming apparatus 100 in the environment of a temperature of 28° C. and a relative humidity of 80% for 12 hours, in the same environment, a solid image of density 100% was continuously printed by 72,000 sides (36,000 sheets) on both surfaces of a print sheet of a letter size. In the printing test, the charge voltage was set to −950 V, the development voltage was set to −200 V, the supply voltage was set to −300 V, and the transfer voltage was set to +2,000 V.

As the image forming apparatus 100, a "black and white printer B731" made by Oki Data Corporation was used. The cleaning blade 11 in which the loss elastic modulus E" was $1.85\times10^4$ Pa at a temperature of 100° C. and a frequency of 10 Hz was used.

Then, the density of the initially printed print pattern (solid image), i.e., an O.D. (Optical Density) value was measured by a spectrodensitometer FX-Rite) (made of X-Rite Corporation).

Figure 9:
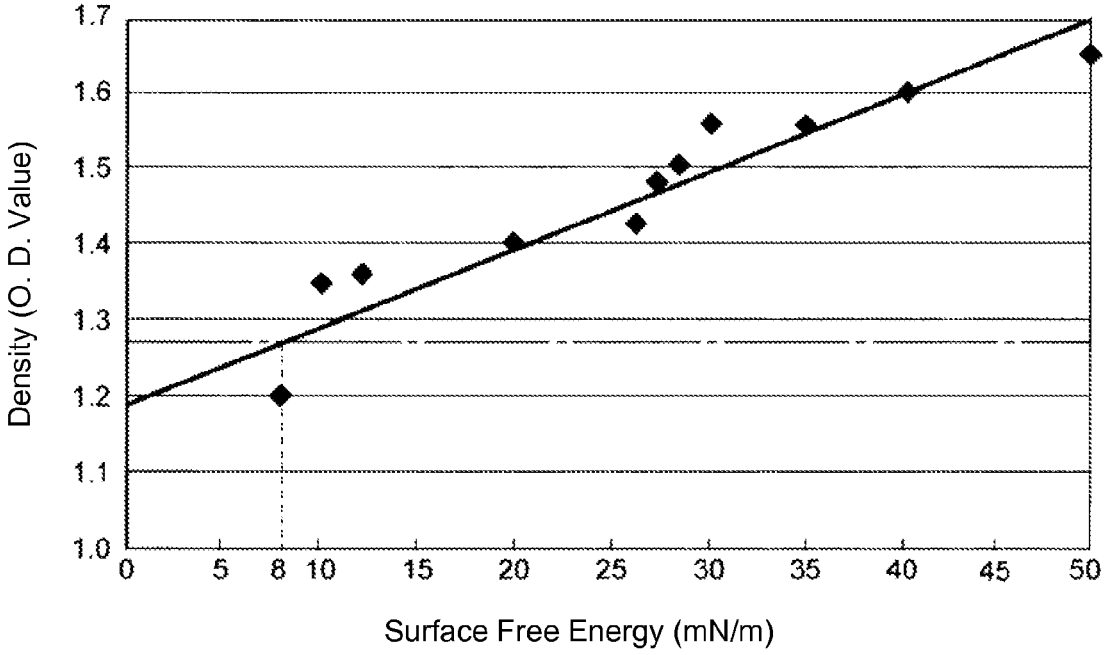
FIG. 9 is a graph showing a relation between a surface free energy of the photosensitive drum and a density (O, D.) of a print image.

The relation between the surface free energy of the photosensitive drum 4 and the density (O.D. value) is shown in the following Table 4. Further, the result of Table 4 is also shown in the graph of FIG. 9. In FIG. 9, the horizontal axis shows a surface free energy (mN/m), and the vertical axis shows the density (O.D. value).

TABLE 4

| Surface free energy (mN/m) | Density (O.D. value) |
|---|---|
| 8 | 1.20 |
| 10 | 1.35 |
| 12 | 1.36 |
| 20 | 1.40 |
| 26 | 1.43 |
| 27 | 1.48 |
| 28 | 1.50 |
| 30 | 1.56 |
| 40 | 1.60 |
| 50 | 1.65 |

From the results of Table 4 and FIG. 9, it is understood that as the surface free energy of the photosensitive drum 4 increases, a higher density can be obtained.

When a photosensitive drum 4 in which the surface free energy is less than 8 mN/m is used, the adhesion of the toner to the photosensitive body decreases, resulting in deteriorated print density, which in turn causes blurring of print images. For this reason, the photosensitive drums 4 in which the surface free energy is less than 8 mN/m were not subjected to experiments. When a photosensitive drum 4 in which the surface free energy exceeds 50 mN/m is used, the adhesion of the toner to the surface of the photosensitive body 4 becomes too strong, causing scumming (phenomena that toner adheres to a non-printing region). For this reason, the photosensitive drums 4 in which the surface free energy exceeds 50 mN/m were not subjected to experiments.

On the other hand, when a photosensitive drum 4 in which the surface free energy is 8 mN/m to 50 mN/m is used, blurring of images and/or scumming are not seen.

Next, experiments of investigating the change of generation state of passing of external additive were performed while changing the surface free energy of the photosensitive drum 4. Ten types of photosensitive drums 4 different in surface free energy as mentioned above were respectively subjected to printing tests by attaching to the image forming apparatus 100. In the printing test, after leaving the image forming apparatus 100 in the environment of a temperature of 28° C. and a relative humidity of 80% for 12 hours, in the same environment, a print patter in which the duty ratio was 20% was continuously printed by 72,000 sides (36,000 sheets) on both surfaces of a print sheet of a letter size.

As the image forming apparatus 100, a "black and white printer B731" made by Oki Data Corporation was used. The cleaning angle θ1 of the cleaning blade 11 with respect to the photosensitive drum 4 was set to 10°, and the processing force (linear pressure) W was set to 12 gf/cm. The cleaning blade 11 in which the loss elastic modulus E" was $1.85\times10^4$ Pa at a temperature of 100° C. and a frequency of 10 Hz was used. The charge voltage was set to −950 V, the development voltage was set to −200 V, the supply voltage was set to −300 V, and the transfer voltage was set to +2,000 V. These voltages were voltages at the time of performing the printing tests, and the voltages for the printing operation of the image forming apparatus of this embodiment are not limited to these voltages.

After completion of the continuous printing of 72,000 sides, the degree of the external additive adhesion was judged by visually observing the surface of the charge roller 5 of the image forming unit 1 of the printer.

As to the degree of the external additive adhesion, the case in which the external additive adhesion on the surface of the charge roller 5 was not at all observed is shown by ◎, and the case in which the external additive adhesion on the surface of the charge roller 5 was observed, but no print image was appeared is shown by ○. Further, the case in which the external additive adhesion on the surface of the charge roller 5 was observed and appeared on the print image is shown by x.

Figure 10:
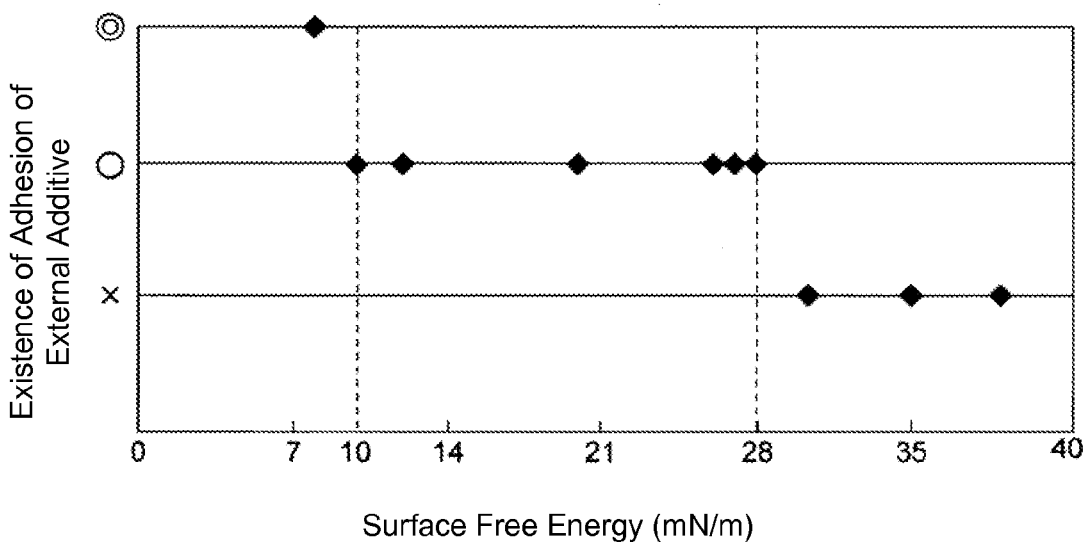
FIG. 10 is a graph showing a relation between a surface free energy of the photosensitive drum and a degree of adhesion of an external additive on the surface of the charge roller.

The relation between the surface free energy of the photosensitive drum 4 and the degree of the external additive adhesion on the surface of the charge roller 5 is shown in Table 5. Further, the results of Table 5 are also shown in the graph of FIG. 10. In FIG. 10, the horizontal axis shows a surface free energy (mN/m), and the vertical axis shows the degree of external additive adhesion.

TABLE 5

| Surface free energy (mN/m) | Existence or non-existence of external additive adhesion |
|---|---|
| 8 | ◎ |
| 10 | ○ |
| 12 | ○ |
| 20 | ○ |
| 26 | ○ |
| 27 | ○ |
| 28 | ○ |
| 30 | X |
| 35 | X |
| 40 | X |

From Table 5 and FIG. 10, it is understood that when the surface free energy of the photosensitive drum 4 exceeds 12 mN/m, passing of external additive occurs.

Combining the results of Table 4 and Table 5 (FIG. 9 and FIG. 10), the most preferable range of the surface free energy of the photosensitive drum 4 is 8 mN/m to 28 mN/m.

Next, the surface free energy of the photosensitive drum 4 is set to be constant, experiments of investigating the relation between the loss elastic modulus E" of the cleaning blade 11 and the generation state of passing of external additive were performed.

Here, as explained in the first embodiment, eight types of cleaning blades 11 different in loss elastic modulus E" were created. The adjusting method and measuring method of the loss elastic modulus E" are as explained in the first embodiment. The eight types of cleaning blades 11 produced as mentioned above were attached to the image forming apparatus 100 and printing tests were performed respectively. In the printing test, after leaving the image forming apparatus 100 in the environment of a temperature of 28° C. and a relative humidity of 80% for 12 hours, in the same environment, a print patter in which the duty ratio was 20% was continuously printed by 72,000 sides (36,000 sheets) on both surfaces of a print sheet of a letter size.

As the image forming apparatus 100, a "black and white printer B731" made by Oki Data Corporation was used. The cleaning angle θ1 (FIG. 3) of the cleaning blade 11 with respect to the photosensitive drum 4 was set to 10°, and the processing force (linear pressure) W was set to 12 gf/cm. The charge voltage was set to −950 V, the development voltage was set to −200 V, the supply voltage was set to −300 V, and the transfer voltage was set to +2,000 V. The surface free energy of the photosensitive drum 4 was set to 50 N/m. Further, the Vickers hardness of the photosensitive drum 4 was set to 8 N/mm$^2$.

After completion of the continuous printing of 72,000 sides, the existence or non-existence of the external additive adhesion was judged by visually observing the surface of the charge roller 5 of the image forming unit 1 of the printer.

Figure 11:
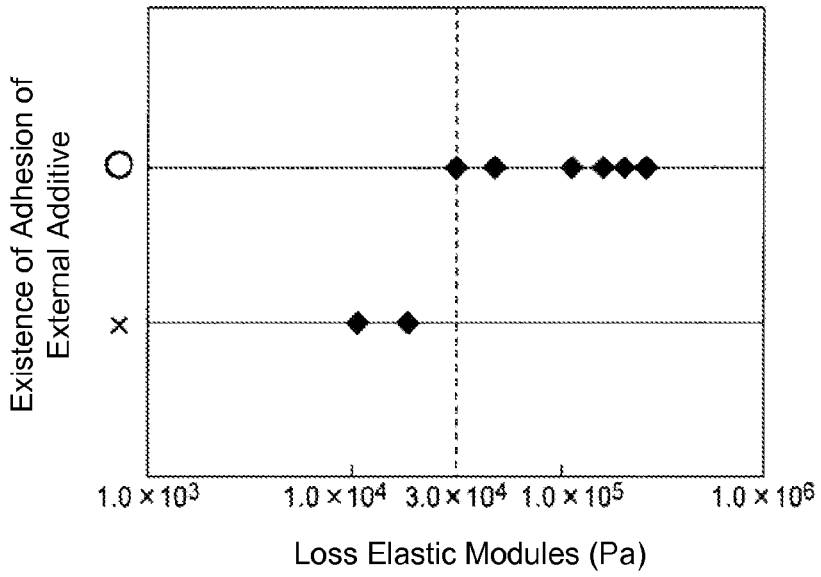
FIG. 11 illustrates a graph showing a relation between a loss elastic modulus of the cleaning blade and an existence or non-existence of adhesion of an external additive on a surface of the charge roller.

The observation results of the loss elastic modulus E" of the cleaning blade 11 at the temperature 100° C. and the frequency 10 Hz and the existence or non-existence of external additive adhesion on the surface of the charge roller 5 are shown in Table 6. Further, the results of Table 6 are also shown in the logarithmic graph of FIG. 11. In FIG. 11, the horizontal axis shows a loss elastic modulus E" (Pa), and the vertical axis shows the existence or non-existence of external additive adhesion As to the degree of the external additive adhesion, the case in which the external additive adhesion on the surface of the charge roller 5 was observed is shown by ○. Further, the case in which the external additive adhesion on the surface of the charge roller 5 was observed is shown by x.

TABLE 6

| Loss elastic modulus (Pa) | Existence or non-existence of external additive adhesion |
|---|---|
| 10,408 | X |
| 18,408 | X |
| 29,944 | ○ |
| 47,706 | ○ |
| 113,048 | ○ |
| 163,048 | ○ |
| 200,705 | ○ |
| 260,705 | ○ |

From Table 6 and FIG. 11, it is understood that when the loss elastic modulus E" of the cleaning blade 11 is 3.00×10$^4$ Pa or more at a temperature of 100° C. and frequency 10 Hz, no adhesion of external additive on the surface of the charge roller 5 occurs (i.e., passing of external additive is controlled).

This is considered because, as explained in the first embodiment, by increasing the loss elastic modulus E" of the cleaning blade 11, the stick-slip distance $L_0$ becomes long, as a result, the cycle of the stick-slip motion becomes long, which in turn can suppress the generation probability of passing of external additive.

Each experiment according to the embodiment was performed by setting the charge voltage to −950 V, the development voltage to −200 V, the supply voltage to −300 V, and the transfer voltage to +2,000 V. However, if the charge voltage is within a range of −400 V to −1,200 V in charge voltage, −50 V to −300 V in development voltage, −2,000 V to −4,000 V in supply voltage, and +1,500 V to +2,500 V, the same effects can be obtained.

Effects of Second Embodiment

As explained above, in the second embodiment of the present invention, the loss elastic modulus E" of the cleaning blade 11 at a temperature of 100° C. and a frequency of 10 Hz was set to fall within a range of 3.00×10$^4$ Pa to 2.61×10$^5$ Pa, and by setting the surface free energy of the photosensitive drum 4 so as to fall within the range of 8 mN/m to 50 mN/m, image forming deficiency such as blurring of images, scumming, etc., can be suppressed.

Further, by setting the surface free energy of the photosensitive drum 4 so as to fall within a range of 8 mN/m to 28 mN/m, it becomes possible to more effectively suppress passing of external additive of the toner.

In the aforementioned first and second embodiments, as an example of the image forming apparatus, a color printer was explained, but the present invention is not limited to a color printer. The present invention can be applied to an image forming application for forming an image on a medium using an electrophotographic system such as a facsimile apparatus, a photocopy apparatus, a printer, an MFP (MultiFunction Peripheral), etc.

What is claimed is:

1. A cleaning blade arranged to contact a surface of an image carrier to remove a developer on the surface of the image carrier, wherein the cleaning blade is made of an elastic body in which a loss elastic modulus at a temperature of 100° C. and a frequency of 10 Hz is set within a range from 3.0×10$^4$ Pa to 2.61×10$^5$ Pa.

2. An image forming apparatus comprising:

an image carrier; and a cleaning blade arranged to contact a surface of the image carrier to remove a developer on the surface of the image carrier, wherein the cleaning blade is made of an elastic body in which a loss elastic modulus at a temperature of 100° C. and a frequency of 10 Hz is set within a range from 3.0×10$^4$ Pa to 2.61×10$^5$ Pa.

3. The image forming apparatus according to claim 2, wherein the developer is a non-magnetic one-component developer that includes mother particles and an external additive added to the mother particles, the mother particles, containing a resin and a coloring agent, a mean particle diameter of the external additive is within a range from 5 nm to 400 nm, and an additive amount of the external additive to the mother particles of 100 parts by weight is within a range from 0.5 parts by weight to 8.0 parts by weight.

4. The image forming apparatus according to claim 2, wherein the developer is a non-magnetic one-component developer that includes mother particles and an external additive added to the mother particle, the mother particles containing a resin and a coloring agent, and a mean particle diameter of the external additive is within a range from 30 nm to 110 nm, and an additive amount of the external additive to the mother particles of 100 parts by weight is within a range from 3.0 parts by weight to 10.0 parts by weight.

5. The image forming apparatus according to claim 2, wherein a Vickers hardness of the surface of the image carrier is within a range from 8 $N/mm^2$ to 35 $N/mm^2$.

6. The image forming apparatus according to claim 5, wherein the Vickers hardness of the surface of the image carrier is within a range from 20 $N/mm^2$ to 35 $N/mm^2$.

7. The image forming apparatus according to claim 2, wherein surface free energy of the image carrier is within a range from 8 mN/m to 50 mN/m.

8. The image forming apparatus according to claim 2, wherein the cleaning blade is arranged such that a cleaning angle ($\theta_1$), which is obtained by subtracting a displacement angle ($\theta_4$) of the cleaning blade from an angle ($\theta_2$) that is defined between a generating line direction of the cleaning blade and a tangential direction of the surface of the image carrier, is within a range from 10° to 15°, the displacement angle ($\theta_4$) is defined by $$\theta_4 = \frac{3 \times y}{2 \times l}$$

where l is a free end length measured from a leading edge of the cleaning blade to a deformation starting point along the surface of the cleaning blade, and y is a push-in amount measured as a height of the leading edge of the surface of the cleaning blade in a perpendicular direction with respect to the surface of the cleaning blade.

9. The image forming apparatus according to claim 2, wherein the cleaning blade is pressed against the surface of the image carrier at a linear pressure within a range from 12 gf/cm to 24 gf/cm.

10. An image forming unit to be installed in an image forming apparatus, the image forming unit comprising:

an image carrier; and a cleaning blade arranged to contact a surface of the image carrier to remove a developer on the surface of the image carrier, wherein the cleaning blade is made of an elastic body in which a loss elastic modulus at a temperature of 100° C. and a frequency of 10 Hz is set within a range from $3.0 \times 10^4$ Pa to $2.61 \times 10^5$ Pa.

11. The image forming unit according to claim 10, wherein the developer is a non-magnetic one-component developer that includes mother particles and an external additive added to the mother particles, the mother particles containing a resin and a coloring agent, a mean particle diameter of the external additive is within a range from 5 nm to 400 nm, and an additive amount of the external additive to the mother particles of 100 parts by weight is within a range from 0.5 parts by weight to 8.0 parts by weight.

12. The image forming unit according to claim 10, wherein the developer is a non-magnetic one-component developer that includes mother particles and an external additive added to the mother particles, the mother particles containing a resin and a coloring agent, and a mean particle diameter of the external additive is within a range from 30 nm to 110 nm, and an additive amount of the external additive to the mother particles of 100 parts by weight is within a range from 3.0 parts by weight to 10.0 parts by weight.

13. The image forming unit according to claim 10, wherein a Vickers hardness of the surface of the image carrier is within a range from 8 $N/mm^2$ to 35 $N/mm^2$.

14. The image forming unit according to claim 13, wherein the Vickers hardness of the surface of the image carrier is within a range from 20 $N/mm^2$ to 35 $N/mm^2$.

15. The image forming unit according to claim 10, wherein surface free energy of the image carrier is within a range from 8 mN/m to 50 mN/m.

16. The image forming unit according to claim 15, wherein the surface free energy of the image carrier is within a range from 8 mN/m to 28 mN/m.

17. The image forming unit according to claim 10, wherein the cleaning blade is arranged such that a cleaning angle ($\theta_1$), which is obtained by subtracting a displacement angle ($\theta_4$) of the cleaning blade from an angle ($\theta_2$) that is defined between a generating line direction of the cleaning blade and a tangential direction of the surface of the image carrier, is within a range from 10° to 15°, the displacement angle ($\theta_4$) is defined by $$\theta_4 = \frac{3 \times y}{2 \times l}$$

where l is a free end length measured from a leading edge of the cleaning blade to a deformation starting point along the surface of the cleaning blade, and y is a push-in amount measured as a height of the leading edge of the surface of the cleaning blade in a perpendicular direction with respect to the surface of the cleaning blade.

18. The image forming unit according to claim 10, wherein the cleaning blade is pressed against the surface of the image carrier at a linear pressure within a range from 12 gf/cm to 24 gf/cm.

19. The image forming unit according to claim 10, wherein the elastic body of the cleaning blade is made of a material including urethane rubber.

20. The image forming unit according to claim 10, wherein an outermost surface of the image carrier is formed by a charge transportation layer.

* * * * *